United States Patent [19]

Crawford

[11] 4,427,081

[45] Jan. 24, 1984

[54] ROTARY ROCK BIT WITH INDEPENDENTLY TRUE ROLLING CUTTERS

[75] Inventor: Micheal B. Crawford, Duncanville, Tex.

[73] Assignee: Dresser Industries, Inc., Dallas, Tex.

[21] Appl. No.: 340,615

[22] Filed: Jan. 19, 1982

[51] Int. Cl.[3] ..... E21B 10/08

[52] U.S. Cl. ..... 175/376

[58] Field of Search ..... 175/331, 376, 378

[56] References Cited

U.S. PATENT DOCUMENTS

| | | | |
|---|---|---|---|
| 2,032,575 | 3/1936 | Harrington | 175/376 |
| 2,228,286 | 1/1941 | Ross | 175/376 X |
| 4,056,153 | 11/1977 | Miglierini | 175/376 |

*Primary Examiner*—James A. Leppink
*Assistant Examiner*—Joseph Falk
*Attorney, Agent, or Firm*—Fred A. Winans

[57] ABSTRACT

A tri-cone rotary rock bit having true rolling conical cutters of different cone angle and with each cutter having a plurality of intermediate annular rows of cutting projections for disintegrating the borehole bottom. Such projections in the intermediate rows being true-rolling about a bottom distinct from the bottom cut by the projections on the remaining intermediate annular rows of the cutting projections of each cone are also at distinct separate distances from the center of rotation of the bit to produce a borehole bottom profile having concentric rows of crests and valleys.

3 Claims, 2 Drawing Figures

ROTARY ROCK BIT WITH INDEPENDENTLY TRUE ROLLING CUTTERS

BACKGROUND OF THE INVENTION

1. Field of the Invention

This invention relates to a rotary rock bit suitable for drilling in extremely hard formations and, more particularly, to a rock bit having a plurality of conical cutters, such as the well known tri-cone bit, with each conical cutter being independently true rolling on a bottom formed by its cutting structure which is distinct from the bottom formed by the cutting structure of the remaining cutters.

2. Description of the Prior Art

Rotary rock bits, particularly tri-cone bits are well known in the earth boring art for drilling oil and gas wells and for drilling blast holes for ore mining operations.

Generally, such bits include a bit body having a plurality of downwardly extending legs (i.e. one for each cutter) terminating in radially inwardly and axially downwardly extending bearing pin on which the conical cutter is mounted. As the earth through which the bit must bore has varying hardness, etc., the bits are custom designed to exhibit cost effective optimum drilling characteristics in an earth formation of particular hardness. Thus, in rather soft formations, the drilling is accomplished by the conical cutters having relatively long cutting structure extending therefrom. Also, the elastic modulous and strength of the cutting structure relative to the softer earth formations permits the use of an offset in the axis of rotation of the cutter with respect to the bit body (i.e. the axis of rotation of the cutter is not coincident with the axis of rotation of the bit body) or an oversize cone can be employed relative to the borehole diameter. In either instance the cutting structure extending from the cutter is not true rolling, thereby providing a scuffing or gouging action during rotation of the cutter that rapidly disintegrates the earth.

However, for progressively harder formations, to prolong the life of the cutters the cutting structure is shortened and made harder and thus more brittle. For the hardest earth formations the cutting structure is generally made of inserts of tungsten carbide or the like which project for a short distance from the surface of the conical cutter. As this material is relatively easily chipped, side loading thereof is avoided and, to this end, the gouging or scuffing action during drilling is eliminated by having the various axes of the cone and bit coincident and by sizing the defined effective conical exterior to the proper size to provide a true-rolling cutter. Such a cutter disintegrates the earth primarily through compressive fragmentation of the rock formation immediately below the insert as it contacts the formation.

A tri-cone rock bit having true rolling cutters is shown in U.S. Pat. No. 4,056,153 of common assignee to the present invention; however, as will be seen upon review of the above patent, the conical cutters are all of a common size (i.e. the true rolling cone defined by each has a single included angle). Thus, each area of earth contacted by the cutting structure projection has substantial lateral support by the adjacent formation of the borehole bottom in that, because of the equal cone angle, the bottom profile is substantially flat, as shown in FIG. 6 of the patent.

SUMMARY OF THE PRESENT INVENTION

The present invention provides a tri-cone rotary rock bit, particularly suited for the hard formations, with each conical cutter true-rolling about a bottom distinct from the bottom cut by the remaining cones so that certain cutting structure sees or contacts a bottom configuration having distinctly reduced lateral support such that disintegration thereof is facilitated. This is generally accomplished by true-rolling conical cutters having separate and unequal cone angles so that each cutting profile is true-rolling about and cuts its own bottom. The composite bottom hole profile defined by the alternating annular rows of cutting elements on the cutter and disposed at unequal radii from the bit center of rotation, is wavy thereby providing a bottom profile having crests of reduced lateral support. The alternating valleys, although having lateral support, are disintegrated as easily as the flat bottom of the prior art bits but the crests are much more easily disintegrated, resulting in more efficient drilling in such hard formations.

DESCRIPTION OF THE PREFERRED EMBODIMENT

The general construction of a rotary rock bit is well known in the art and is adequately described in U.S. Pat. No. 3,788,408 of common assignee with the present invention. Further, previously identified U.S. Pat. No. 4,056,153 generally describes the conical cutter portion of a rotary rock bit and the relationship of the rotational axes and cutting structure profile which provides true-rolling contact between the cutting elements and the earth formation.

Figure 1:
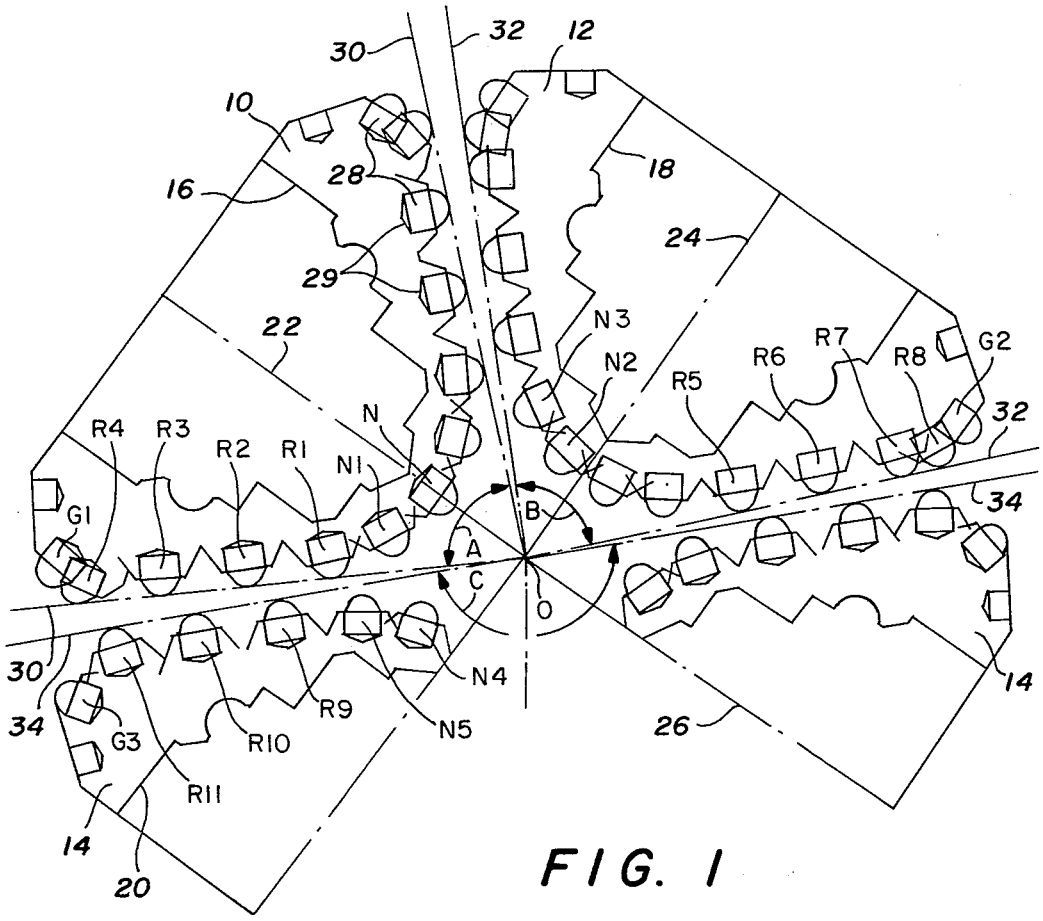
FIG. 1 is a standard cluster layout of the conical cutters of a tri-cone rotary rock bit constructed in accordance with the present invention; and, FIG. 2 is a superimposed axial cross-sectional view of the composite conical cutters in contact with the borehole bottom and showing the borehole bottom profile resulting therefrom.

Thus reference is made to FIG. 1 herein which is a well-known cluster layout of the conical cutters of a tri-cone rock bit. As therein seen, the three cutters 10, 12 and 14 (with cutter 14 being shown in two halves to illustrate the spatial relationship of cutting elements on adjacent cutters 10 and 12) all define a generally triangular axial cross-section illustrative of their conical configuration with the nose or apex of each cone extending towards the rotational center O of the bit.

Also, each cutter includes a central bore 16, 18 and 20 respectively, open at the base of the conical cutter and defining in conjunction with the bearing pin on each downwardly extending leg of the bit (not shown), a bearing and lubricant cavity for rotatively mounting the conical cutters on the bit body. Thus, cutter 10 rotates about axis 22, cutter 12 rotates about axis 24 and cutter 14 rotates about axis 26 as the bit rotates about the central axis O. In that each cutter axis intersects central axis O, there is no offset to any of the cutters.

The conical cutters include annular rows of cutting elements projecting outwardly from their surface for contacting and disintegrating the earth formations. For hard earth formations these projections generally comprise inserts such as 28 of tungsten carbide pressed into appropriately sized and spaced sockets, such as 29, in the cutters.

In each cutter certain intermediate annular rows of inserts are provided for contacting and forming the greater portion of the borehole bottom, whereas other rows generally disintegrate the borehole adjacent the rotational axis of the bit and the remaining rows disintegrate the borehole adjacent the wall thereof to maintain the borehole gage diameter.

Still referring to FIG. 1, it is seen that a line joining the outermost projection of the inserts 28 of intermediate annular rows R1, R2, R3 and R4 of cutter 10 forms a straight line 30 which also intersects center O and that such line 30, on diametrically opposite sides of the cutter, intersects center O and defining therebetween a first included angle A. These intermediate annular inserts provide the cone-driving inserts. It will also be noted that inserts in annular row N1 and nose insert N do not extend to line 30 nor to the inserts in gage row G1.

Cutter 12 likewise has intermediate annular rows R5, R6, R7 and R8 of inserts with the radially outermost extent thereof lying in a common line 32 which also intersects the center O and with diametrically opposite line 32 intersecting at an angle B which is different than angle A of cone 10.

Similarly, cutter 14 has intermediate rows R9, R10 and R11 of inserts, with the radially outermost extent thereof lying in a common line 34 which also intersects the center O and with diametrically opposite line 34 forming an angle C which is different than either angle A or B.

Like cutter 10, the cutters 12 and 14 have rows of inserts adjacent the nose N2, N3 and N4, N5 respectively and gage rows G2 and G3 respectively which do not extend to the respective common line of the intermediate inserts.

Thus, as is well known in the art, each cone will be true-rolling with respect to the inserts in intermediate annular rows prefixed by R. However, in that the included angles A, B, and C of each true-rolling cutter engagement are different, while the angle D (See FIG. 2) between the bearing pins and the axis of rotation is equal for all bearing pins of the bit, each conical cutter 10, 12 and 14 will be true-rolling at a different and distinct borehole bottom.

Figure 2:
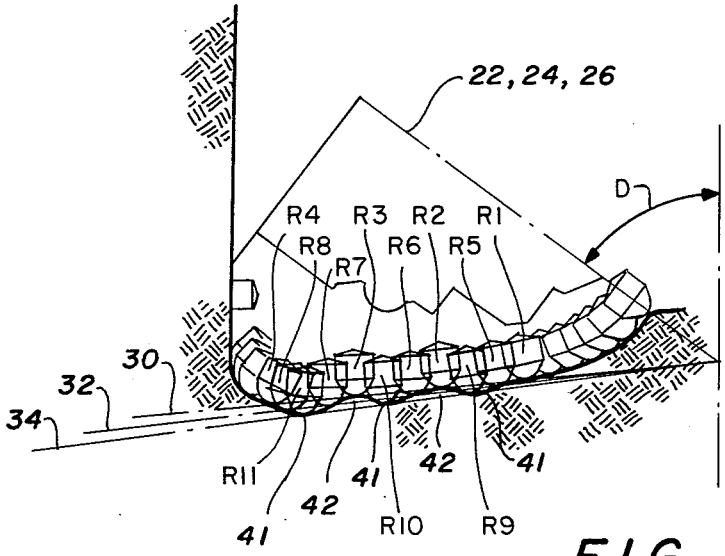

Thus, referring to FIG. 2, a profile of a typical borehole bottom as cut or formed by the action of the three conical cutters 10, 12 and 14 is shown. As therein seen, inserts in annular rows R1, R2, R3 and R4 of cutter 10 form a bottom along true-rolling line 30; inserts in annular rows R5, R6, R7 and R8 of cutter 12 cut along and form a bottom along true-rolling line 32 and inerts in annular row R9, R10 and R11 of cutter 14 form a bottom along true-rolling line 34. The resultant profile is a wavy configuration defining concentric alternating peaks 42 and valleys 41, with the peaks having limited lateral support which facilitates compressive fragmentation thereof.

Further, the concentric peaks and valleys provide greater stability in guiding the bit (i.e. tend to limit off-center movement of the bit across the ridges) resulting in straighter holes and less gage wear on the inserts in the gage rows. Also, the true-rolling cutters provide less cutting structure wear and breakage in the bottom engaging rows, resulting in a longer life bit.

I claim:

1. A rock bit for drilling a borehole having a plurality of rotary conical cutters supported on bearing pins defining the rotary axis of each cutter at a common angle with respect to the axis of rotation of said bit and each of said cutters having a plurality of intermediate annular rows of cutting structure projecting therefrom with the outermost extent of each projection, when rotated to a common plane, interconnectable by a generally straight line which intersects the axis of rotation of the bit and the rotary axis of the cutter, whereby said intermediate cutting structure has true rolling contact with the borehole bottom and wherein diametrically opposed interconnecting straight lines of each cutter converge to intersect at an angle, with said last mentioned angle of each cutter being distinctly different from the like defined angle of any other cutter on said bit whereby each cutter cuts a bottom formation on true-rolling engagement and further contacts the borehole bottom at distinctly different angle than the remaining cutters thereby resulting in a wavy bottom configuration.

2. A rock bit according to claim 1 wherein each intermediate annular row of cutting structure of each cutter is at a distinctly different radius for the axis of rotation of the bit.

3. A rock bit according to claim 2 wherein there are at least three conical cutters on said bit, and wherein the intermediate annular rows of at least one conical cutter are each disposed at a radii between but adjacent to the radius of intermediate rows on each of the remaining cutters and forming a borehole bottom line between the bottom lines of said remaining cutters to define a borehole bottom of concentric ridges and valleys.

* * * * *